US005161515A

United States Patent [19]

Hammonds

[11] Patent Number: 5,161,515

[45] Date of Patent: Nov. 10, 1992

[54] REVERSIBLE ARCHERY ARROW HOLDER AND ARROW REST DEVICE

[76] Inventor: David R. Hammonds, 3462 Druck Valley Rd., York, Pa. 17402

[21] Appl. No.: 310,363

[22] Filed: Jan. 31, 1989

[51] Int. Cl.[5] ..... F41B 5/22

[52] U.S. Cl. ..... 124/44.5; 124/24.1

[58] Field of Search ..... 124/41 A, 24 R, 88, 124/44.5, 24.1

[56] References Cited

U.S. PATENT DOCUMENTS

| | | | |
|---|---|---|---|
| 2,743,716 | 5/1956 | Wendh . | |
| 2,777,435 | 1/1957 | Brooks . | |
| 3,890,951 | 6/1975 | Jennings et al. | 124/44.5 |
| 3,919,997 | 11/1975 | Day | 124/4 A |
| 4,038,960 | 8/1977 | Ludwig . | |
| 4,282,850 | 8/1981 | Warnicke | 124/24 R |
| 4,318,390 | 3/1982 | Trotter | 124/41 A |
| 4,332,232 | 6/1982 | Trancoso, Jr. | 124/41 A X |
| 4,351,311 | 9/1982 | Phares | 124/41 A |
| 4,398,528 | 8/1983 | Troncoso, Jr. | 124/41 A X |
| 4,407,261 | 10/1983 | Elliott | 124/41 A |
| 4,421,092 | 12/1983 | Christian | 124/41 A |
| 4,598,688 | 7/1986 | Paul et al. | 124/44.5 |
| 4,686,956 | 8/1987 | Troncoso, Jr. | 124/41 A |
| 4,703,745 | 11/1987 | Hammond . | |
| 4,748,964 | 6/1988 | Troncoso, Jr. . | |
| 4,890,596 | 1/1990 | Barlow | 124/44.5 |

OTHER PUBLICATIONS

1985 Target Archery Catalog T-21 Fletch Saver Rest.

Hunter Supreme Arrow Rest Instruction Sheets, See FIG. 2 and exploded isometric, Golden Key Futura, Inc.

Snap Shot flyer from Precision Design Co., Distributed at sport & outdoor shows in 1987.

*Primary Examiner*—Peter M. Cuomo

*Attorney, Agent, or Firm*—Donald E. Nist

[57] ABSTRACT

The reversible archery arrow holder rest device includes a bracket having a side plate mounted on an archery bow sidewall, and a rear clamp. The clamp adjustably holds a pair of vertically spaced cross-arms behind the bow riser, which arms extend transversely to a point behind the bow window and support a pair of blades, namely, the rest blade and the holder blade. Thus, the rest includes an upwardly and forwardly projecting resilient blade, the front end of which has a side surface which slopes downwardly towards the bow sidewall. The holder is above the rest and includes a downwardly and forwardly extending resilient blade, the front end of which has a side surface which slopes upwardly towards the bow sidewall. A first arrow vane-receiving space is between the front ends of the rest and holder. A second connecting space is defined by the rest, holder and bow sidewall and receives the remaining vanes and shaft of the arrow for free clearance during arrow flight from the bow. The device may include a fitting bearing a depressible side pressure point button in the bow window to contact the side of the arrow shaft. The device is simple, durable, and provides improved arrow flight. It can be inverted and reversed for use on both left-handed and right-handed bows.

42 Claims, 2 Drawing Sheets

REVERSIBLE ARCHERY ARROW HOLDER AND ARROW REST DEVICE

BACKGROUND OF THE INVENTION

1. Field of the Invention

The present invention generally relates to sports equipment and more particularly to an improved reversible combination archery arrow holder and rest.

2. Prior Art

Various types of arrow rest have been employed in the past. See, For example, the rests of U.S. Pat. Nos. 4,748,964; 3,935,854; 236,497; 4,489,704: 4,398,528; 3,865,096; and 4,332,232, as well as others. Most arrow rests of the prior art are not reversible and most do not prevent arrow roll off from the rest during drawing of the arrow. Therefore, various types of arrow holders have also been devised, mainly to prevent such arrow roll off from the rest. See, for example, U.S. Pat. Nos. 4,748,963; 4,703,745; 4,038,960; 2,743,716 and 2,777,435. Most such holders unduly pin down and restrict the arrow so as to hamper arrow flight.

Moreover, none of these patents and any known prior art disclose combination arrow rests and holders which could provide the desired functions of both seating and holding the arrow, while allowing full clearance of the arrow vanes or feathers when the arrow is shot from the rest, and which could be reversed so as to be useful for both left-handed and right-handed archers. Therefore, there remains a need for such any improved combination reversible arrow rest and arrow holder. Such device should be simple, durable, efficient and inexpensive.

SUMMARY OF THE INVENTION

The improved combination reversible arrow holder and rest device of the present invention satisfies all the foregoing needs. The device constitutes a substantial improvement in an archery bow which includes the device. The device is substantially as set forth in the Abstract of the Disclosure.

Thus, the device includes a bracket comprising a side plate adapted to be mounted on the bow riser sidewall opposite the arrow window, and a rear clamp which adjustably holds a vertically spaced parallel pair of horizontal cross-arms behind the bow riser. The cross-arms extend to behind the arrow window and adjustably hold a pair of blades, one of which comprises the arrow rest and the other of which comprises the arrow holder. The rest blade extends upwardly and forwardly into the window from the lower cross-arm, while the holder blade extends forwardly and downwardly into the window from the upper cross-arm.

The front ends of the arrow rest and arrow holder are spaced apart a sufficient distance to provide a gap which permits the passage of an arrow vane or feather therebetween. Both front ends are sloped on one side thereof towards the bow sidewall, the rest side being sloped downwardly and the holder side being sloped upwardly. A space between the rest, holder and sidewall permits the free passage of the arrow shaft and remaining vanes or feathers during shooting of an arrow from the bow.

Preferably, the two blades are substantially identical in length, width and configuration. Also preferably, the device includes a depressible side pressure button against which the side of the arrow shaft rests, while being held on the rest sloped side by the holder sloped side. The front ends of the rest and holder are preferably equidistant below and above, respectively, the side pressure button; that is, the gap is at the level of the button. This three point contact assures proper holding of the arrow to prevent it from rolling off the arrow, while also assuring its proper alignment in the bow, shot after shot, for maximum shooting accuracy.

The device prevents archers from endangering others with arrows rolling off before or while they are shot from the bow or having the arrow improperly aligned. It also assures that a nervous bowhunter will be able to carry the arrow on the bow in the properly aligned ready-to-draw-and-fire position, and therefore be able to instantly draw and shoot accurately when game appears.

Another important feature of the device is that it is reversible as a unit for shooting either left-handed or right-handed. Thus, the device can, for example, be detached from a right-handed bow, inverted and then connected to and used in a left-handed bow. The depressible side pressure button can form a part of the device and can be reversed and used therewith.

There is no need to purchase separate holders and rests and try to attach them and make them cooperate. Instead, the present device provides an integral unit with both holder and rest, and also preferably the side pressure button, fully adjustably connected to the bracket which is easily installed in a bow.

Various other features of the present invention are set forth in the following detailed description and accompanying drawings.

DRAWINGS

DETAILED DESCRIPTION

FIGS. 1-3

Figure 1:
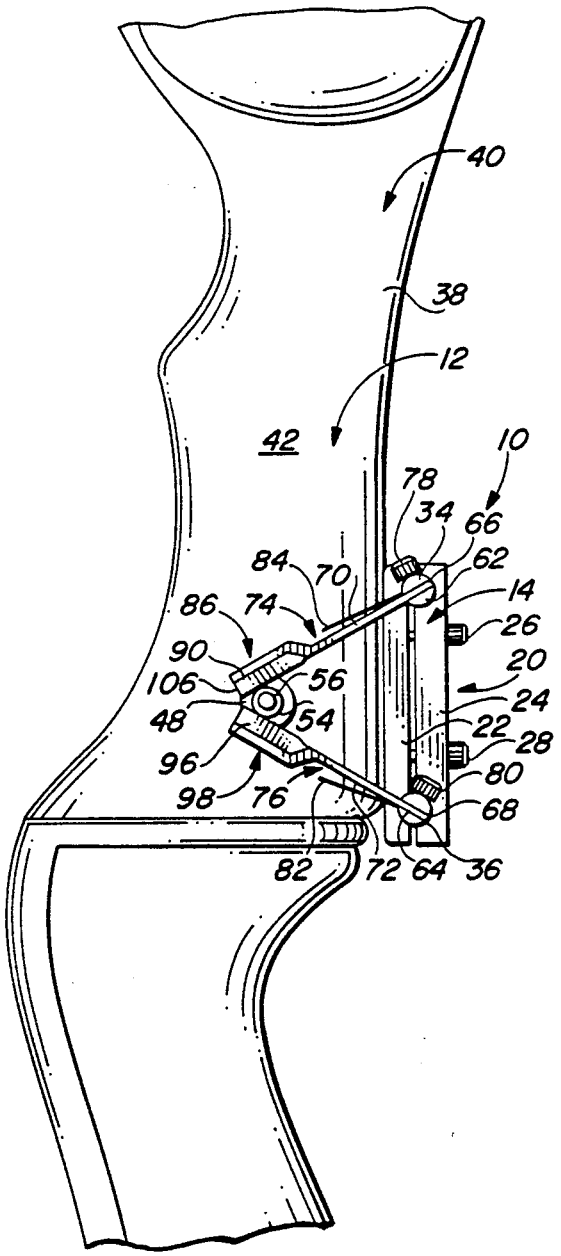
FIG. 1 is a schematic side elevation of a first preferred embodiment of the improved combination arrow holder and arrow rest device of the present invention installed in and forming the improvement in an archery bow.
Figure 2:
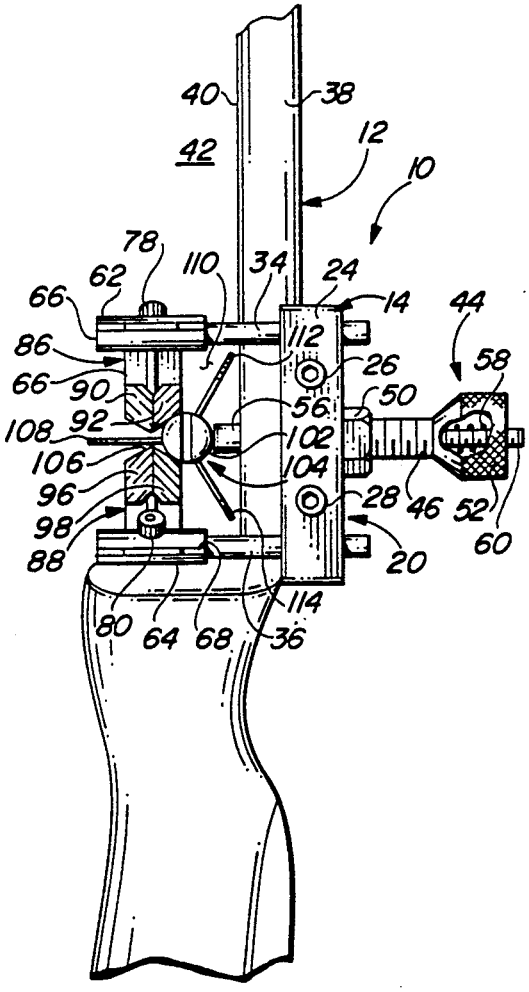
FIG. 2 is a schematic rear elevation, partly broken away, of the device of FIG. 1 installed in the archery bow of FIG. 1.
Figure 3:
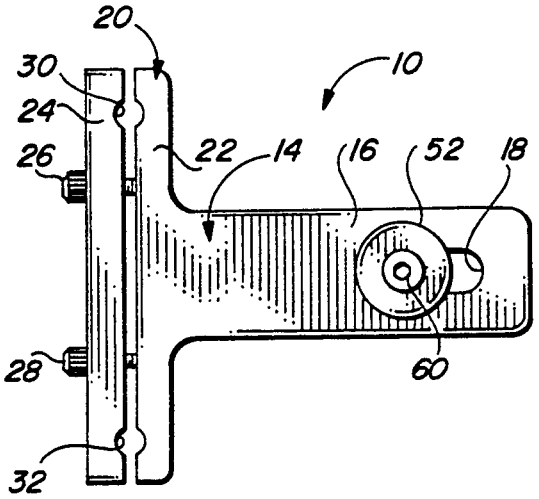
FIG. 3 is a schematic side elevation of the bracket of the device of FIG. 1.

Now referring more particularly to FIGS. 1-3 of the drawings, a first preferred embodiment of the improved combination arrow rest and holder of the present invention is schematically depicted therein. Thus, device 10 is shown mounted on an archery bow 12 to form a desired improvement in that bow.

Device 10 includes a base or T-shaped bracket 14 consisting essentially of an elongated, flat side plate 16 bearing an elongated slot 18 in the front portion thereof, and an integral vertical clamp 20 at the rear of plate 16 and comprised of two vertical blocks or jaws 22 and 24 releasably secured together by screws 26 and 28 passing forwardly therethrough in screw holes (not shown) therein. Jaws 22 and 24 may be configured to provide transverse horizontal cylindrical openings 30 and 32

(FIG. 3) extending therethrough for the reception of the cross-arms hereinafter described.

Device 10 includes upper and lower horizontal cylindrical support members or cross-arms 34 and 36 releasably held in openings 30 and 32, respectively, in bracket 14 by screws 26 and 28. Plate 16 preferably is connected to sidewall 38 in the handle riser section 40 of bow 12 at the level of bow arrow window 42, as by a fitting 44 comprising a conventional so-called "Burger button" device comprising an elongated screw 46 passing through slot 18 and through sidewall 38, specifically, through a threaded sleeve 48 in sidewall 38, with a threaded bolt 50 being disposed around screw 46, pinning fitting 44 and plate 16 in place in bow 12. Screw 46 has an expanded head 52 and a central passageway 54 longitudinally therethrough bearing a long cylindrical pressure button 56 biased transversely into window 42 by a conventional coiled spring 58 in passageway 54, spring 58 being adjustably held in place by a small set screw 60 in passageway 54.

When bracket 14 is in place on bow 12, as shown in FIGS. 1 and 2, clamp. 20 is behind riser section 40, as are cross-arms 34 and 36. Those arms extend transversely to a position directly behind window 42 and include expanded ends 62 and 64, respectively, bearing slots 66 and 68, respectively, releasably receiving the flat rear ends 70 and 72. respectively, of leaf rests or holder and rest blades 74 and 76, respectively. Ends 70 and 72 are releasably pinned in place by set screws 78 and 80, respectively.

Blades 74 and 76 preferably are resilient and flexible and preferably of plastic or spring steel or the like. The bottom rear of blade 76 and the top rear of blade 74 preferably are backed by thin flat spring steel blades 82 and 84, respectively, received in slots 68 and 66, respectively, which blades 82 and 84 act as flex limit means for blades 76 and 74.

The front portions 86 and 88, respectively, of blades 74 and 76 are V-shaped, blade 74 having sides 90 and 92 which slope upwardly from center ridge 94, while blade 76 has sides 96 and 98 which slope downwardly from center ridge 100. Side 98 of rest blade 76 supports shaft 102 of arrow 104 while side 92 of holder blade 74 prevents arrow 104 from rolling off rest blade 76 and forces shaft 102 up against button 56, as shown in FIG. 2.

Front portions 86 and 88 terminate just above and below, respectively, button 56 (FIGS. 1 and 2) to provide a first space 106 sufficiently large to permit the passage of arrow vane 108 therethrough during firing of arrow 104 from bow 12. Space 106 is connected to space 110 defined by sides 92 and 98, sidewall 38 and button 56 and through which remaining arrow vanes 112 and 114 freely pass on shaft 102, during shooting of arrow 104, all without striking sides 92 and 98, sidewall 38 and button 56, so as to assure accurate unimpeded shooting of arrow 104 from bow 12. Before such shooting, shaft 102 is securely held in space 110 in a fixed position by sides 92 and 98 against button 56, so that each time arrow 104 is drawn to be shot, it is in the same position. Consequently, each shot taken with arrow 104 is identical, for improved performance and accuracy. Arrow 104 cannot roll off of rest blade 76, even when carried for long distances while connected to a bowstring (not shown) of bow 12 and disposed on rest blade 76.

The distance and angle between front portions 86 and 88 can be adjusted by loosening screws 26 and 28, then rotating arms 34 and 36, then retightening screws 26 and 28. The distance of blades 74 and 76 from sidewall 38 can be similarly adjusted, first by loosening screws 26 and 28, then by sliding arms 34 and 36 transversely, then by retightening screws 26 and 28. The length of blades 74 and 76 can also be adjusted, merely by loosening screws 78 and 80 and sliding rear ends 70 and 72 back and forth in slots 66 and 68. Accordingly, device 10 is fully adjustable. The resistance of button 56 to depression by shaft 102 and the length of button 56 in window 42 can be controlled by adjusting screw 60 and screw 46, respectively.

FIG. 4

Figure 4:
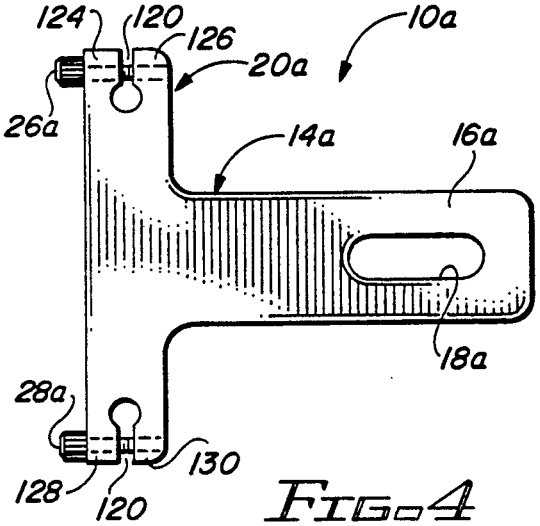
FIG. 4 is a schematic side elevation of another preferred embodiment of the bracket of the device of the present invention; and, FIG. 5 is a schematic rear elevation of a second preferred embodiment of the device of the present invention mounted on a archery bow.

A modified version of the bracket used in the present device is schematically depicted in FIG. 4. Thus, bracket **14*a* is shown. Components thereof similar to those of bracket 14** bear the same numerals but are succeeded by the letter "a".

Bracket **14*a* differs from bracket 14** only as follows:

Instead of two separate vertical jaws, clamp **20*a* has two aligned spaced vertical slots 120 and 122 transversely through clamp 20*a*, slot 120 being at the top of clamp 20*a* and slot 122 being at the bottom of clamp 20*a*. Slot 120 is defined by opposing jaws or prongs 124 and 126 forwardly through which passes screw 26*a*, while slot 122 is defined by opposing jaws or prongs 128 and 130, through which forwardly passes screw 28*a*. Bracket 14*a* performs similarly to bracket 14**.

FIG. 5.

Figure 5:
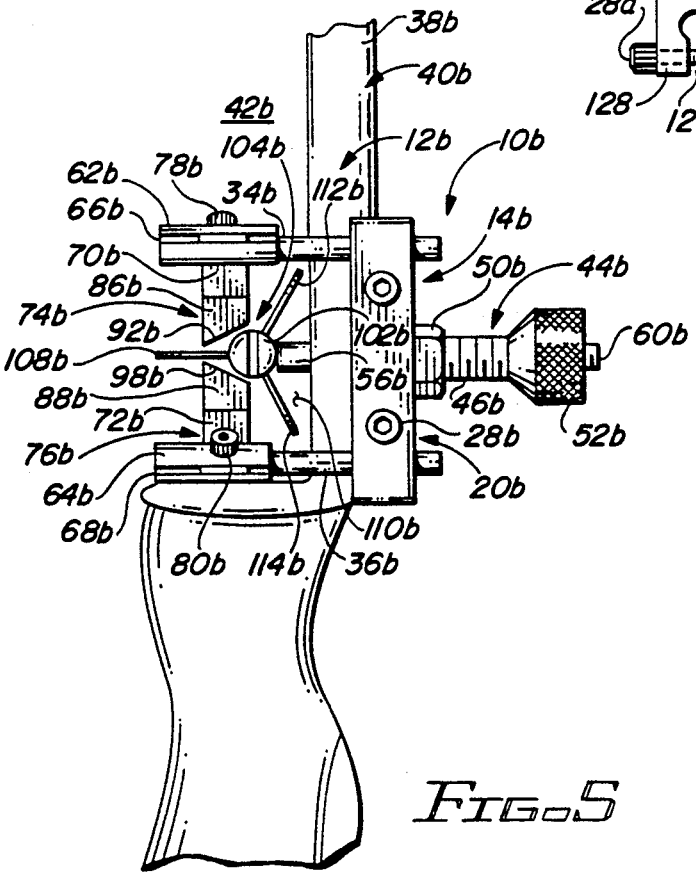

A second preferred embodiment of the improved device of the present invention is schematically depicted in FIG. 5. Thus, device **10*b* is shown. Components thereof similar to those of device 10** bear the same numerals but are succeeded by the letter "b".

Device **10*b* differs from device 10** only as follows:

Front portions **86*b* and 88*b* of blades 74*b* and 76*b* have only one sloped side each, that is, the side that faces sidewall 38, in other words, sloped sides 92*b* and 98*b*, respectively, not sides comparable to sides 90 and 96. Device 10*b* performs similarly to device 10**.

Various other modifications, changes, alterations and additions can be made in the improved combination arrow rest and arrow holder device of the present invention and in the bow incorporating the same as an improvement. All such modifications, changes, alterations and additions are are within the scope of the appended claims form part of the present invention.

What is claimed is:

1. An arrow support device for holding an arrow with respect to a bow, said support device comprising:

substantially T-shaped base means formed by substantially transverse plate and clamp portions;

means for securing said base means to the blow;

a pair of flexible leaf rests, each flexible leaf rest including an angular surface adapted to rest against the surface of the arrow shaft;

support means including a pair of elongated support members securing said pair of flexible leaf rests to said base means;

clamp means securing said support members adjacent to opposite ends of said clamp portion, said clamp means including a pair of slots in said clamp portion forming two pairs of opposing jaws dimensioned for engagement with said support means and a screw spanning each of said slots and extending between said jaws for selectively tightening said jaws into clamping engagement with said support members; and said support means securing said pair of flexible leaf rests to said base means in vertically spaced, substantially overlying relation when the device is secured to a bow which is held in a normal upright shooting position, said support means including means to permit independent lateral and vertical adjustment of each of said flexible leaf rests, said flexible leaf rests converging with each other forming a generally V-shape having an apex proximate to a region of contact of the flexible leaf rests with the surface of the arrow shaft, whereby the angular surfaces of the flexible leaf rests are useable together to support and confine the arrow shaft.

2. The arrow support device of claim 1, further comprising a first aperture extending through said plate portion for mounting said base means to a bow, said base means being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow.

3. The arrow support device of claim 1, further comprising flex limit means for limiting deformation of said flexible leaf rests.

4. The arrow support device of claim 3, wherein said flex limit means comprises a pair of spring steel blades backing said flexible leaf rests.

5. An arrow support device for holding an arrow with respect to a bow, said support device comprising:

substantially T-shaped base means formed by substantially transverse plate and clamp portions;

means for securing said base means to the bow;

a pair of flexible leaf rests, each flexible leaf rest including an angular surface adapted to rest against the surface of the arrow shaft;

support means including a pair of elongated support members securing said pair of flexible leaf rests to said base means;

clamp means securing said support members adjacent to opposite ends of said clamp portion, said clamp means including a block, two pairs of opposing jaws formed on said block and said clamp portion dimensioned for engagement with said support members and at least one screw extending between said block and said base means for selectively tightening said pairs of jaws into clamping engagement with said support members; and said support means securing said pair of flexible leaf rests to said base means in vertically spaced, substantially overlying relation when the device is secured to a bow which is held in a normal upright shooting position, said support means including means to permit independent lateral and vertical adjustment of each of said flexible leaf rests, said flexible leaf rests converging with each other forming a generally V-shaped having an apex proximate to a region of contact of the flexible leaf rests with the surface of the arrow shaft, whereby the angular surfaces of the flexible leaf rests are useable together to support and confine the arrow shaft.

6. The arrow support device of claim 5, further comprising a first aperture extending through said plate portion for mounting said base means to a bow, said base means being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow.

7. The arrow support device of claim 5, further comprising flex limit means for limiting deformation of said flexible leaf rests.

8. The arrow support device of claim 7, wherein said flex limit means comprises a pair of spring steel blades backing said flexible leaf rests.

9. An arrow support device for holding an arrow with respect to a bow, said support device comprising:

substantially T-shaped base means formed by substantially transverse plate and clamp portions;

means for securing said base means to the bow;

a pair of flexible leaf rests, each flexible leaf rest including an angular surface adapted to rest against the surface of an arrow shaft;

support means including a pair of elongated support members securing said pair of flexible leaf rests to said base means;

clamp means securing said support members adjacent to opposite ends of said clamp portion; said clamp means including a pair of slots in said clamp portion forming two pairs of opposing jaws dimensioned for engagement with said support members and a screw spanning each of said slots and extending between said jaws for selectively tightening said jaws into clamping engagement with said support members; and said support means securing said pair of flexible leaf rests to said base means in vertically spaced, substantially overlying relation when the device is secured to a bow which is held in a normal upright shooting position, said pair of flexible leaf rests substantially symmetrically disposed with respect to said base means such that said arrow support device is invertible for reversible use with both left-handed and right-handed bows, said flexible leaf rests converging with each other forming a generally V-shape having an apex proximate to a region of contact of the flexible leaf rests with the surface of the arrow shaft, whereby the angular surfaces of the flexible leaf rests are useable together to support and confine the arrow shaft.

10. The arrow support device of claim 9, further comprising a first aperture extending through said plate portion for mounting said base means to a bow, said base means being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow.

11. The arrow support device of claim 9, further comprising flex limit means for limiting deformation of said flexible leaf rests.

12. The arrow support device of claim 11, wherein said flex limit means comprises a pair of spring steel blades backing said flexible leaf rests.

13. An arrow support device for holding an arrow with respect to a bow, said support device comprising:

substantially T-shaped base means formed by substantially transverse plate and clamp portions;

means for securing said base means to the bow;

a pair of flexible leaf rests, each flexible leaf rest including an angular surface adapted to rest against the surface of an arrow shaft;

support means including a pair of elongated support members securing said pair of flexible leaf rests to said base means;

clamp means securing said support members adjacent to opposite ends of said clamp portion, said clamp means including a block, two pairs opposing jaws formed on said block and said clamp portion dimensioned for engagement with said support members and at least one screw extending between said block and said base means for selectively tightening said pairs of jaws into clamping engagement with said support members; and said support means securing said pair of flexible leaf rests to said base means in vertically spaced, substantially overlying relation when the device is secured to a bow which is held in a normal upright shooting position, said pair of flexible leaf rests substantially symmetrically disposed with respect to said base means such that said arrow support device is invertible for reversible use with both left-handed and right-handed bows, said flexible leaf rests converging with each other forming a generally V-shape having an apex proximate to a region of contact of the flexible leaf rests with the surface of the arrow shaft, whereby the angular surfaces of the flexible leaf rests are useable together to support and confine the arrow shaft.

14. The arrow support device of claim 13, further comprising a first aperture extending through said plate portion for mounting said base means to a bow, said base means being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning sad arrow shaft laterally from the second side of the bow.

15. The arrow support device of claim 13, further comprising flex limit means for limiting deformation of said flexible leaf rests.

16. The arrow support device of claim 15, wherein said flex limit means comprises a pair of spring steel blades backing said flexible leaf rests.

17. An arrow support device for holding an arrow in a laterally and vertically fixed, slidable position with respect to a bow substantially regardless of the position of the bow when held for shooting, said support device comprising:

a substantially T-shaped base formed by substantially transverse plate and clamp portions, said base including a first aperture extending through said base for mounting the base to a bow, said base being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow;

a pair of flexible leaf rests, each flexible leaf rest including an angular surface adapted to rest against the surface of the arrow shaft;

support means including a pair of elongated support member securing said pair of flexible leaf rests to said base;

clamp means securing said support members adjacent to opposite ends of said clamp portion, said clamp means including a pair of slots in said clamp portion forming two paris of opposing jaws dimensioned for engagement with said support members and a screw spanning each of said slots and extending between said jaws for selectively tightening said jaws into clamping engagement with said support members; and said support means securing said pair of flexible leaf rest to said base in vertically spaced, substantially overlying relation when the device is secured to a bow which is held in a normal upright shooting position, said flexible leaf rests converging with each other forming a generally V-shape having an apex proximate to the first end of said plunger, whereby the angular surfaces of the flexible leaf rests and the first end of the plunger are useable together to support and confine the arrow shaft at three circumferentially spaced points.

18. The arrow support device of claim 17, further comprising flex limit means for limiting deformation of said flexible leaf rests.

19. The arrow support device of claim 18, wherein said flex limit means comprises a pair of spring steel blades backing said flexible leaf rests.

20. An arrow support device for holding an arrow in a laterally and vertically fixed, slidable position with respect to a bow substantially regardless of the position of the bow when held for shooting, said support device comprising:

a substantially T-shaped base formed by substantially transverse plate and clamp portions, said base including a first aperture extending through said base for mounting the base to a bow, said base being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow;

a pair of flexible leaf rests, each flexible leaf rest including an angular surface adapted to rest against the surface of the arrow shaft;

support means including a pair of elongated support members securing said pair of flexible leaf rests to said base;

clamp means securing said support members adjacent to opposite ends of said clamp portion, said clamp means including a block, two pairs of opposing jaws formed on said block and said clamp portion dimensioned for engagement with said support members and at least one screw extending between said block and said base for selectively tightening said pairs of jaws into clamping engagement with said support members; and said support means securing said pair of flexible leaf rests to said base in vertically spaced, substantially overlying relation when the device is secured to a bow which is held in a normal upright shooting position, said flexible leaf rests converging with each other forming a generals V-shape having an apex proximate to the first end of said plunger, whereby the angular surfaces of the flexible leaf rests and the first end of the plunger are useable together to support and confine the arrow shaft at three circumstantially spaced points.

21. The arrow support device of claim 20, further comprising flex limit means for limiting deformation of said flexible leaf rests.

22. The arrow support device of claim 21, wherein said flex limit means comprises a pair of spring steel blades backing said flexible leaf rests.

23. An arrow support device for holding an arrow in a laterally and vertically fixed, slidable position with respect to a bow substantially regardless of the position of the bow when held for shooting, said support device comprising:

a substantival T-shaped base formed by substantially transverse plate and clamp portions, said base including a first aperture extending through said base for mounting the base to a bow, said base being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow;

a pair of flexible leaf rests, each flexible leaf rest including an angular surface adapted to rest against the surface of the arrow shaft;

support means including a pair of elongated support members securing said pair of flexible leaf rests to said base;

clamp means securing said support members adjacent to opposite ends of said clamp portion, said clamp means including a pair of slots in said clamp portion forming two pairs of opposing jaws dimensioned for engagement with said support means and a screw spanning each of said slots and extending between said jaws for selectively tightening said jaws into clamping engagement with said support members; and said support means securing said pair of flexible leaf rests to said base in vertically spaced, substantially overlying relation when the device is secured to a bow which is held in a normal upright shooting position, said pair of flexible leaf rests substantially symmetrically disposed with respect to said base such that said arrow support device is invertible for reversible use with both left-handed and right-handed bows, said flexible leaf rests converging with each other forming a generally V-shaped having an apex proximate to the first end of said plunger, whereby the angular surfaces of the flexible leaf rests and the first end of the plunger are useable together to support and confine the arrow shaft at three circumferentially spaced points.

24. The arrow support device of claim 23, further comprising flex limit means for limiting deformation of said flexible leaf rests.

25. The arrow support device of claim 24, wherein said flex limit means comprises a pair of spring steel blades backing said flexible leaf rests.

26. An arrow support device for holding an arrow in a laterally and vertically fixed, slidable position with respect to a bow substantially regard less of the position of the bow when held for shooting, said support device comprising:

a substantially T-shaped base formed by substantially transverse plate and clamp portions, said base including a first aperture extending through said base for mounting the base to a bow, said base being positionable on a side of the bow and securable thereto by a known fastening plunger extending through said first aperture, said fastening plunger adapted to also extend through an aperture in the bow, whereby a first end of said plunger extends from a side of the bow to engage one surface of an arrow shaft for positioning said arrow shaft laterally from the second side of the bow;

a pair of flexible leaf rests, each flexible leaf rest including an angular surface adapted to rest against the surface of the arrow shaft;

support means including a pair of elongated support members securing said pair of flexible leaf rests to said base;

clamp means securing said support members adjacent to opposite ends of said clamp portion, said clamp means including a block, two pairs of opposing jaws formed on said block and said clamp portion dimensioned for engagement with said support members and at least one screw extending between said block and said base for selectively tightening said pairs of jaws into clamping engagement with said support members; and said support means securing said pair of flexible leaf rests to said base in vertically spaced, substantially overlying relation when the device is secured to a bow which is held in a normal upright shooting position, said pair of flexible leaf rests substantially symmetrically disposed with respect to said base such that said arrow support device is invertible for reversible use with both left-handed and right-handed bows, said flexible leaf rests converging with each other forming a generally V-shaped having an apex proximate to the first end of said plunger, whereby the angular surfaces of the flexible leaf rests and the first end of the plunger are useable together to support and confine the arrow shaft at three circumferentially spaced points.

27. The arrow support device of claim 26, further comprising flex limit means for limiting deformation of said flexible leaf rests.

28. The arrow support device of claim 27, wherein said flex limit means comprises a pair of spring steel blades backing said flexible leaf rests.

29. An arrow support device for holding an arrow in a laterally and vertically fixed, slidable position with respect to a bow substantially regardless of the position of the bow when held for shooting, said support device comprising:

an integral symmetrical base including a first aperture extending through said base for mounting the base to the bow, said base being positionable on a first side of the bow and securable thereto by a known fastening plunger extending through said first aperture, said fastening plunger adapted to also extend through an aperture in the bow, whereby a first end of said plunger extends from a second side of the bow to engage one surface of an arrow shaft for positioning said arrow shaft laterally from the second side of the bow;

a pair of flexible leaf rests, each flexible leaf rest including a front portion possessing two diverging angular sides intersecting at a center ridge and forming a substantially V-shaped configuration, an upper one of said flexible leaf rests possessing an upwardly opening substantially V-shaped configuration and a lower one of said flexible leaf rests possessing a downwardly opening substantially V-shaped configuration;

a pair of elongated support members securing said pair of flexible leaf rests to said base in vertically spaced, substantially overlying relation when the device is secured to a bow which is held in a normal upright shooting position and mounting each of said flexible leaf rests for independent lateral and vertical adjustment, each of said leaf rests disposed substantially parallel with a plane extending parallel to a line of arrow flight, said pair of flexible leaf rests substantially symmetrically disposed with respect to said base such that said arrow support device is invertible for reversible use with both left-handed and right-handed bows, said flexible leaf rests each secured to and extending substantially perpendicularly from a corresponding support member such that said flexible leaf rests converge with each other forming a generally V-shape having an apex proximate to the first end of said plunger, whereby the angular surfaces of the flexible leaf rests and the first end of the plunger are useable together to support and confine the arrow shaft at three circumferentially spaced points.

30. The arrow support device of claim 29, further comprising clamp means securing said support members to said base.

31. The arrow support device of claim 30, wherein said clamp means comprises a pair of slots in said base forming two pairs of opposing jaws dimensioned for engagement with said support members; and a pair of screws spanning said slot sand extending between said pairs of jaws for selectively tightening said jaws into clamping engagement with said support members.

32. The arrow support device of claim 30, wherein said clamp means comprises a block;

two pairs of opposing jaws formed on said block and said base dimensioned for engagement with said support members; and at least one screw extending between said block and said base for selectively tightening said jaws into clamping engagement with said support members.

33. The arrow support device of claim 29, wherein said base is substantially T-shaped and formed by substantially transverse plate and clamp portions.

34. The arrow support device of claim 33, wherein said clamp means comprises a pair of slots in said clamp portion forming two pairs of opposing jaws dimensioned for engagement with said support members; and a screw spanning each of said slots and extending between said jaws for selectively tightening said jaws into clamping engagement with said support members.

35. The arrow support device of claim 33, wherein said clamp means comprises a block;

two pairs of opposing jaws formed on said block and said clamp portion dimensioned for engagement with said support members; and at least one screw extending between said block and said base for selectively tightening said pairs of jaws into clamping engagement with said support members.

36. The arrow support device of claim 29, further comprising flex limit means for limiting deformation of said flexible leaf rests.

37. The arrow support device of claim 36, wherein said flex limit means comprises a pair of spring steel blades backing said flexible leaf rests.

38. In an archery bow which includes a pair of limbs connected to a central handle riser section having a sidewall and shelf defining an arrow window, the improvement which comprises a left-right reversible archery arrow holder and arrow rest device connected only to said sidewall and extending into said window, said device comprising, in combination:

a. a bracket comprising a plate adjustably secured to said sidewall, said plate extending rearwardly of said riser section and bearing at the rear end thereof adjustable clamp means, said plate and clamp means being integral and T-shaped, comprising a front flat plate portion with elongated slot and rear vertical clamp block with two spaced vertical cross-arm-receiving slots on opposite ends of said block, each defining a pair of jaws drawable towards each other by screws to adjustably clamp cross-arms;

b. a first transverse cross-arm releasably secured at one end thereof to said clamp means and extending behind said riser section, the opposite end of said cross-arm terminating in an area behind said arrow window, said opposite end of said first cross-arm bearing a forwardly and upwardly extending, flexible resilient arrow rest in said widow, said rest having an upper arrow shaft-supporting side surface sloped downwardly toward said sidewall; and, c. a second transverse cross-arm releasably secured at one end thereof to said clamp means and extending behind said riser section above said first cross- arm, the opposite end of said second cross-arm extending to an area behind said window, said opposite end of said second cross- arm bearing a downwardly and forwardly extending flexible resilient arrow holder in said window, said holder having a lower, arrow shaft-holding side surface sloped upwardly toward said sidewall; the front ends of said rest and said holder being spaced apart sufficiently to define a first space adapted to receive a first vane of an arrow, said sloping side surfaces defining with said sidewall a second space connected to said first space and adapted to receive the shaft and the remaining vanes of an arrow; said device being invertible and reversible for use with both left-handed and right-handed archery bows.

39. The improvement of claim 38 wherein said holder and rest have similar size and configuration to facilitate said reversibility.

40. The improvement of claim 38 wherein said device includes a fitting bearing a depressible side pressure point button extending transversely through said sidewall into said window at about the level of said first space, whereby said arrow shaft is supported by said rest, holder and side pressure point in said second space.

41. The improvement of claim 38 wherein each of said holder and rest has a front portion which is generally V-shaped and comprises two diverging sloping sides, and wherein the rear portion of said holder and said rest comprises a blade, backed by flex limit means.

42. The improvement of claim 38 wherein said rest and holder are similar in size and shape, each comprising an elongated plastic blade, the front portion of which has a V-shaped configuration with sides sloping away from the center thereof and wherein said blades are backed by flat spring limit means, the rear ends of said blades being adjustable clamped to said cross-arms and said cross-arms being adjustable transversely in said window and rotatable therein to adjust the angle and spacing of the front ends of said rest and holder in said window.

* * * * *